US009551514B2

(12) United States Patent
Tartakovsky

(10) Patent No.: US 9,551,514 B2
(45) Date of Patent: Jan. 24, 2017

(54) CONDENSING UNIT AND FAN COIL SYSTEM

(71) Applicant: Epic Industries, LLC, San Francisco, CA (US)

(72) Inventor: Igor Tartakovsky, San Francisco, CA (US)

(73) Assignee: EPIC INDUSTRIES, LLC, San Francisco, CA (US)

( * ) Notice: Subject to any disclaimer, the term of this patent is extended or adjusted under 35 U.S.C. 154(b) by 288 days.

(21) Appl. No.: 14/273,996

(22) Filed: May 9, 2014

(65) Prior Publication Data

US 2015/0292778 A1 Oct. 15, 2015

Related U.S. Application Data

(60) Provisional application No. 61/974,555, filed on Apr. 3, 2014.

(51) Int. Cl.
*F25B 13/00* (2006.01)
*F24F 1/02* (2011.01)

(52) U.S. Cl.
CPC ..... *F25B 13/00* (2013.01); *F24F 1/022* (2013.01)

(58) Field of Classification Search
CPC ..... F25B 43/02; F25B 31/002; F25B 13/00; F25B 1/10; F25B 29/04
USPC ..... 62/324.1, 298, 473, 498, 509
See application file for complete search history.

(56) References Cited

U.S. PATENT DOCUMENTS 4,828,171 A * 5/1989 Akin, Jr. ..... F24H 9/02 165/58

* cited by examiner

*Primary Examiner* — Melvin Jones
(74) *Attorney, Agent, or Firm* — Merchant & Gould, P.C.

(57) ABSTRACT

A heating and cooling system for use in high-rise residential and commercial buildings may include condensing unit having dimensions no greater than 12 inches deep by 40 inches wide by 20 inches tall and a fan coil unit coupled to the condensing unit via refrigeration tubing. The fan coil unit may have dimensions of no greater than 14 inches deep by 43 inches wide by 11 inches tall. The condensing unit may include a condenser water connection, a refrigeration tubing connection, a compressor, and a heat exchanger. The fan coil unit may include a filter rack configured to hold a MERV 13 filter, two in-line high-pressure fans, and at least one access panel on a bottom surface of the fan coil unit.

20 Claims, 3 Drawing Sheets

CONDENSING UNIT AND FAN COIL SYSTEM

CROSS-REFERENCE TO RELATED APPLICATION

The present application claims priority to U.S. Provisional Patent Application No. 61/974,555 entitled "Condensing Unit", as filed on Apr. 3, 2014. The full disclosures of all of the above-listed patent applications are hereby incorporated by reference herein.

FIELD

The present application relates to heating and cooling systems. More specifically, the application relates to a condensing unit and fan coil system for heating and cooling systems.

BACKGROUND

Heating, ventilation and air conditioning ("HVAC") systems are very large, expensive systems in commercial and multi-residence buildings. One of the parts of an HVAC system that takes up a large amount of space is the heat pump unit. Due to limited floor-to-floor heights in high-rise residential buildings (typically 8'9" to 9'6"), these buildings use floor-mounted vertical heat pumps. The pumps are placed in dedicated closets, for architectural and acoustical reasons. Such closets must have clear inside dimensions of at least 30 inches by 30 inches, which represents over 10 square feet of valuable space. Thus, HVAC units often pose challenges in building design and require cumbersome, dedicated HVAC closets.

An alternative to a vertical heat pump unit is a water cooled split system. Such a system has two components: a condensing unit and fan-coil unit. A typical, commercial-sized water cooled condensing unit is designed for 3-6 tons of cooling. The size of such units is still relatively large, for example having dimensions such as 40" H by 31" W by 22" D.

Commercially available fan coil units are designed for low static pressure drops. A typical external static pressure drop (ESP) is 0.25". This creates problems when filters are required or there is a need for extensive ductwork.

Based on the shortcomings of currently available HVAC systems, it would be advantageous to have smaller HVAC units that still had sufficient capacity to be used in a large commercial or residential building.

BRIEF SUMMARY

The present disclosure is directed to an HVAC system that includes a condensing unit and a fan coil unit. The condensing unit and fan coil system is smaller than currently available commercial HVAC systems. As the inventor of the present application discovered that a typical apartment requires less than 3 tons of cooling, it became apparent that commercially available condensing units are larger and more cumbersome than necessary, and a smaller HVAC system could be developed.

Therefore, the present application provides a considerably smaller condensing unit, which in one embodiment measures only 38" W×17" H×11" D. A fan coil component of the system is capable of handling up to approximately 0.7" of ESP, while maintaining a slim height of approximately 11".

DETAILED DESCRIPTION

The various embodiments of an HVAC system, including a condensing unit and fan coil unit, described herein will help minimize HVAC space requirements in commercial and multi-residence high rise buildings. The condensing unit described herein is configured to provide 3 tons of cooling or less and is generally small enough to be installed in a typical clothing closet, such as on the floor or incorporated into closet shelving. This eliminates the need for a dedicated closet designed specifically for a condenser. A fan coil component of the system may have a height of approximately 10-11 inches, which is considerably smaller than conventional units.

Figure 1B:
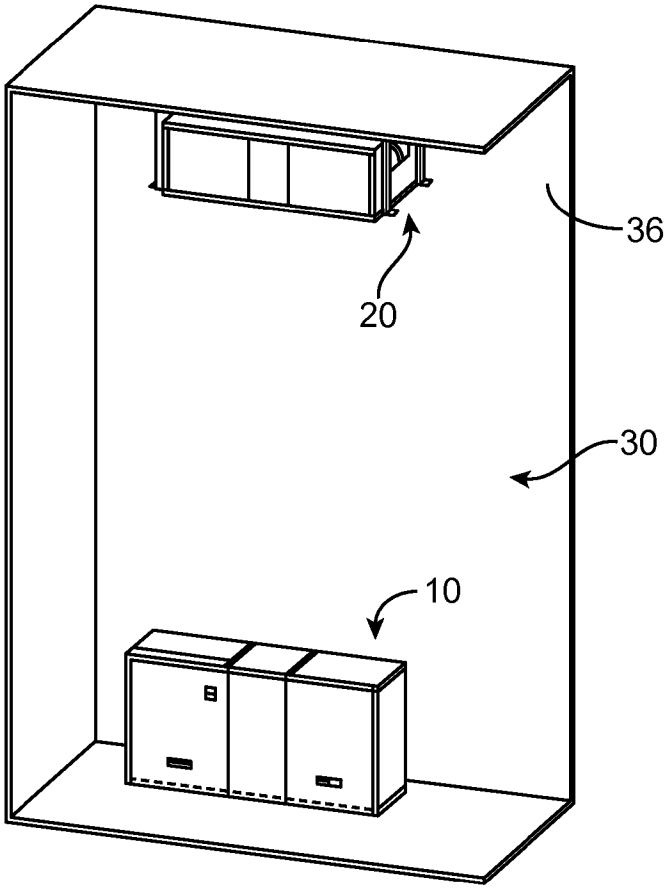
FIGS. 1A and 1B are side and perspective views, respectively, of an HVAC system including a condensing unit and a fan coil unit, according to one embodiment.
Figure 1A:
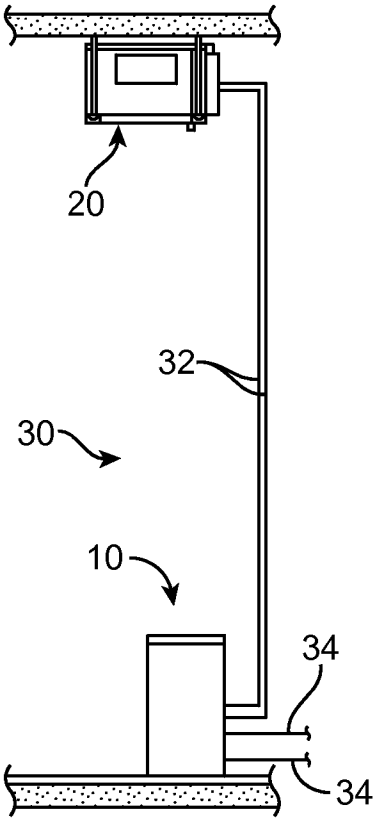

Referring to FIGS. 1A and 1B, in one embodiment, an HVAC system 30 may include a condensing unit 10 and a fan coil unit 20, connected to each other via refrigeration lines 32. The condensing unit 10 may be coupled with one or more water lines 34 for cooling fluid (e.g., water). As illustrated in FIG. 1B, the HVAC system 30 may be located in a standard-sized clothes closet 36. In various alternative embodiments, the condensing unit 10 and the fan coil unit 20 may be positioned in any suitable manner relative to one another and within an apartment or other building. For example, although the fan coil unit 20 is illustrated as attached to the ceiling or the top of the closet, this positioning may be altered in alternative embodiments.

Referring to FIGS. 2A-2D, top, front, side and perspective views, respectively, of a condensing unit 10 according to one embodiment are provided. In this embodiment, the condensing unit 10 is an R-410A condensing unit for use in high-rise residential and commercial buildings. (R-410A is a zeotropic, but near-azeotropic, mixture of difluoromethane (CH2F2, called R-32) and pentafluoroethane (CHF2CF3, called R-125), which is used as a refrigerant in air conditioning applications.) The condensing unit 10 may be housed in a cabinet 17 with an access panel 18, and it may include a compartment for condenser water and refrigeration piping connections 12, a compressor 14, and a heat exchanger 16.

Figure 2A:
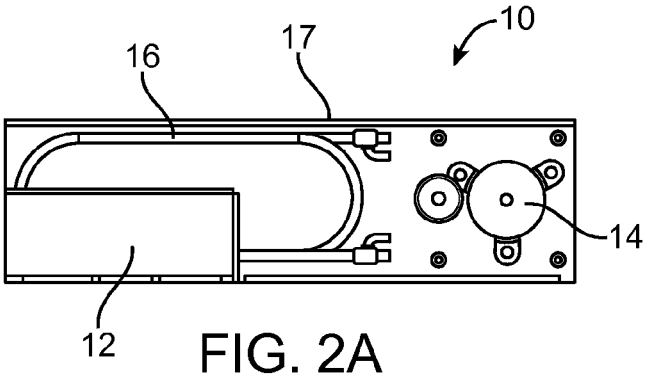
FIGS. 2A-2D are top, front, side cross-section and perspective views, respectively, of a condensing unit for use in an HVAC system, according to one embodiment.
Figure 2B:
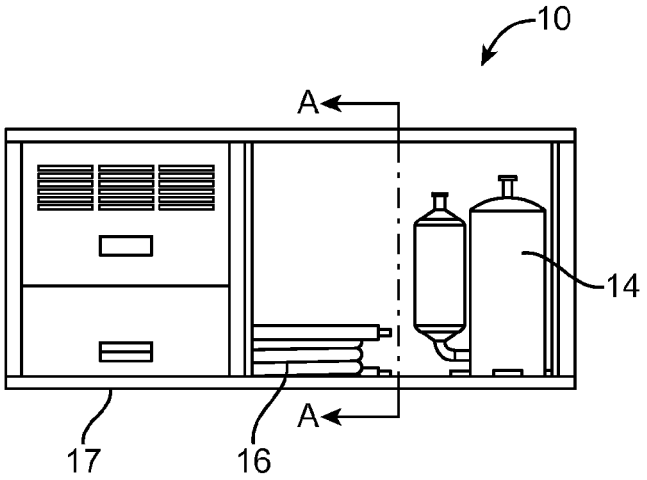
Figure 2C:
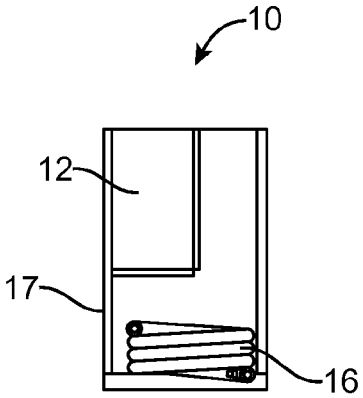
Figure 2D:
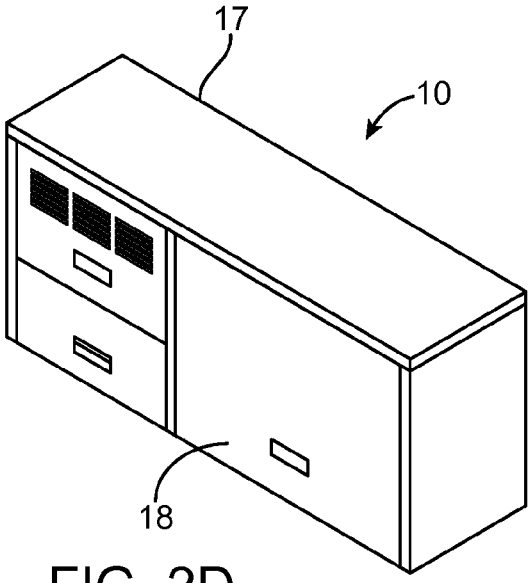
Figure 3C:
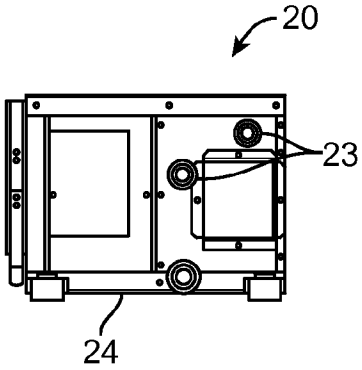
FIGS. 3A-3D are top, rear, side and perspective views, respectively, of a fan coil unit for use in an HVAC system, according to one embodiment.
Figure 3D:
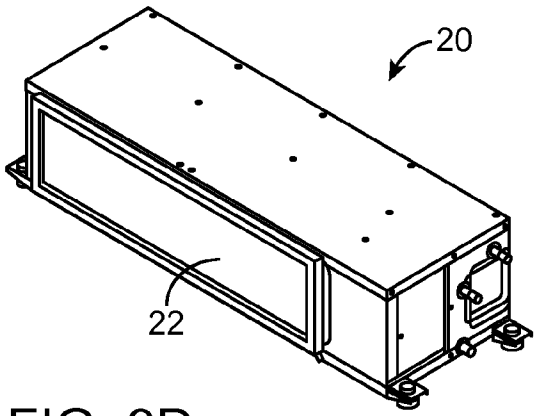
Figure 3A:
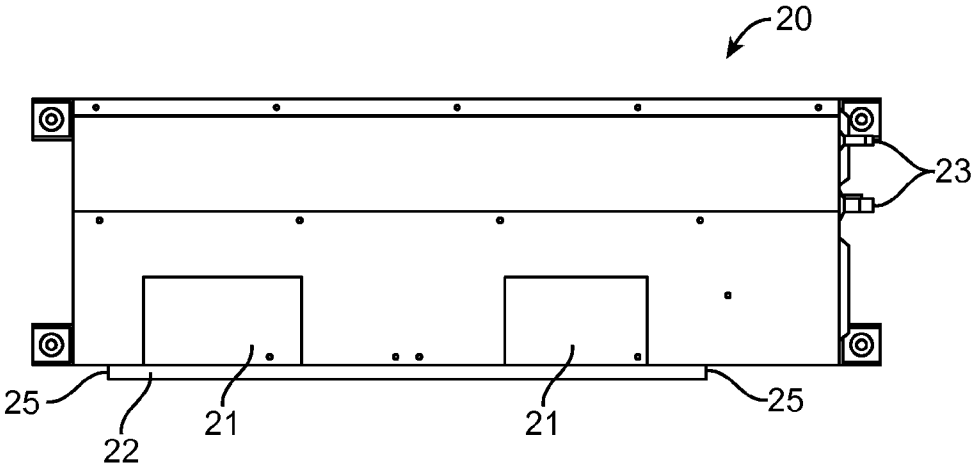
Figure 3B:
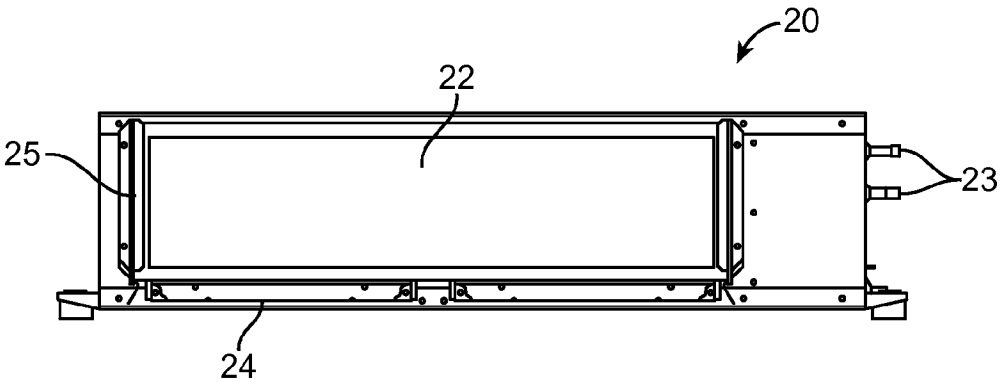

Various embodiments of the condensing unit 10 may weigh approximately 1-3 tons, for example about 1.5 tons, about 2 tons, about 2.5 or about 3 tons. The condensing unit 10 may also have a lower capacity than a conventional commercial-size condensing unit, such as half of the typical capacity or a maximum capacity of no more than about 3 tons of cooling or of less than about 3 tons of cooling, in various embodiments. Such embodiments will typically be small enough to fit into a small cabinet 17. For example, in some embodiments, the condensing unit 10 may have dimensions no larger than approximately 12 inches deep by approximately 40 inches wide by approximately 20 inches tall. In one particular embodiment, as illustrated in FIGS. 2B and 2C, the condensing unit 10 may have dimensions of approximately 11 inches deep by approximately 38 inches wide by approximately 17.5 inches tall. In various embodiments, the condensing unit 10 may be connected to a single fan coil unit or to multiple fan coil units.

Referring now to FIGS. 3A-3D, top, rear, side and perspective views, respectively, of a fan coil unit 20 according to one embodiment are provided. The fan coil unit 20 may include two in-line, high-pressure fans 21, a filter rack 25 for holding a filter 22, quick-connect couplings 23 and one or more access panels 24. The filter rack 22 may be capable of handling MERV 13 filters. (The minimum efficiency reporting value, commonly known as the MERV rating, is a measurement scale designed in 1987 by the American Society of Heating, Refrigerating and Air-Conditioning Engineers (ASHRAE), to rate the effectiveness of air filters.) Currently, MERV 13 filters are typically used only in hospitals. However, using a high-pressure, low profile fan coil unit 20 such as that shown in FIGS. 3A-3C, MERV 13 filters may be used in residential and hotel applications.

The fan coil unit 20 may include multiple "quick-connect couplings," for coupling with a condensing unit via refrigeration lines 32 (FIG. 1A). This promotes ease of installation. One or more access panels 24 to access internal components may be located on the bottom of the fan coil unit 20, thus greatly simplifying access to a ceiling's plenum-mounted unit for maintenance purposes. In some embodiments, the fan coil unit 20 may have dimensions no larger than approximately 43 inches wide, approximately 11 inches tall, and approximately 14 inches deep. In one embodiment, the fan coil unit 20 may have dimensions of approximately 42 inches wide, approximately 10 inches tall, and approximately 14 inches deep. In the embodiment illustrated in FIGS. 3A-3D, the specific dimensions are about 38 inches wide for the box portion of the fan coil unit 20, about 42.180 inches wide for the fan coil unit 20 including connectors, about 10.120 inches tall, and about 13.923 inches deep including the filter 22. These are only examples of dimensions, and alternative embodiments may have other dimensions.

Although this invention has been disclosed in the context of certain embodiments and examples, the present invention extends beyond the specifically disclosed embodiments to other alternative embodiments and/or uses of the invention and modifications and equivalents thereof. Thus, it is intended that the scope of the present invention herein disclosed should not be limited by the particular disclosed embodiments described above.

What is claimed is:

1. A heating and cooling system for use in high-rise residential and commercial buildings, the system comprising:

a condensing unit having dimensions no greater than 12 inches deep by 40 inches wide by 20 inches tall, the condensing unit comprising:
- a condenser water connection;
- a refrigeration tubing connection;
- a compressor; and
- a heat exchanger; and a fan coil unit coupled to the condensing unit via refrigeration tubing, the fan coil unit having dimensions of no greater than 14 inches deep by 43 inches wide by 11 inches tall, the fan coil unit comprising:
- a filter rack configured to hold a MERV 13 filter;
- two in-line high-pressure fans; and
- at least one access panel on a bottom surface of the fan coil unit.

2. The system of claim 1, wherein the fan coil unit further comprises at least one quick-connect coupling for connecting the fan coil unit with the refrigeration tubing.

3. The system of claim 1, further comprising a cabinet in which the condensing unit is housed.

4. The system of claim 1, wherein the condensing unit weighs less than three tons.

5. The system of claim 1, further comprising at least one refrigeration tube for connecting the condensing unit to the fan coil unit.

6. The system of claim 1, wherein the system has a maximum output capacity of less than three tons of cooling.

7. A heating and cooling system for use in high-rise residential and commercial buildings, the system comprising:

a condensing unit having dimensions no greater than 12 inches deep by 40 inches wide by 20 inches tall and weighing less than three tons; and a fan coil unit coupled to the condensing unit via refrigeration tubing, the fan coil unit having dimensions of no greater than 14 inches deep by 43 inches wide by 11 inches tall.

8. The system of claim 7, wherein the condensing unit comprises:
- a condenser water connection;
- a refrigeration tubing connection;
- a compressor; and
- a heat exchanger.

9. The system of claim 8, wherein the fan coil unit comprises:
- a filter rack configured to hold a MERV 13 filter;
- two in-line high-pressure fans; and
- at least one access panel on a bottom surface of the fan coil unit.

10. The system of claim 9, wherein the fan coil unit further comprises at least one quick-connect coupling for connecting the fan coil unit with the refrigeration tubing.

11. The system of claim 7, further comprising a cabinet in which the condensing unit is housed.

12. The system of claim 7, further comprising at least one refrigeration tube for connecting the condensing unit to the fan coil unit.

13. The system of claim 1, wherein the system has a maximum output capacity of less than three tons of cooling.

14. A heating and cooling system for use in high-rise residential and commercial buildings, the system comprising:

a condensing unit having dimensions no greater than 12 inches deep by 40 inches wide by 20 inches tall; and a fan coil unit coupled to the condensing unit via refrigeration tubing, the fan coil unit having dimensions of no greater than 14 inches deep by 43 inches wide by 11 inches tall, wherein the system has a maximum output capacity of less than three tons of cooling.

15. The system of claim 14, wherein the condensing unit comprises:
- a condenser water connection;
- a refrigeration tubing connection;
- a compressor; and
- a heat exchanger.

16. The system of claim 15, wherein the fan coil unit comprises:
- a filter rack configured to hold a MERV 13 filter;
- two in-line high-pressure fans; and
- at least one access panel on a bottom surface of the fan coil unit.

17. The system of claim 16, wherein the fan coil unit further comprises at least one quick-connect coupling for connecting the fan coil unit with the refrigeration tubing.

18. The system of claim 14, further comprising a cabinet in which the condensing unit is housed.

19. The system of claim 14, further comprising at least one refrigeration tube for connecting the condensing unit to the fan coil unit.

20. The system of claim 14, wherein the condensing unit weighs less than three tons.

* * * * *